US005893403A

United States Patent [19]

Megens

[11] Patent Number: 5,893,403

[45] Date of Patent: Apr. 13, 1999

[54] LIFTING FOLDING DOOR

[75] Inventor: Johannes Hendrikus Megens, Ck Ulft, Netherlands

[73] Assignee: Rolflex Nederland B. V., Ae Ulft, Netherlands

[21] Appl. No.: 08/803,402

[22] Filed: Feb. 20, 1997

Related U.S. Application Data

[63] Continuation of application No. PCT/NL95/00317, Sep. 22, 1995.

[30] Foreign Application Priority Data

Sep. 23, 1994 [NL] Netherlands ..... 9401556
Jan. 20, 1995 [NL] Netherlands ..... 9500106

[51] Int. Cl.[6] ..... E04F 10/08

[52] U.S. Cl. ..... 160/35; 160/207

[58] Field of Search ..... 160/35, 36, 201, 160/202, 206, 207, 189

[56] References Cited

U.S. PATENT DOCUMENTS

| | | | |
|---|---|---|---|
| 3,280,888 | 10/1966 | Davis | 160/35 |
| 3,618,656 | 11/1971 | Young | 160/189 |
| 4,374,537 | 2/1983 | Lindbergh | 160/189 |
| 4,379,478 | 4/1983 | Lichy | 160/35 |
| 4,460,030 | 7/1984 | Tsunemura et al. | 160/35 |
| 4,538,661 | 9/1985 | Henry et al. | 160/35 |
| 4,603,723 | 8/1986 | Sugihara | 160/35 |

FOREIGN PATENT DOCUMENTS

| | | |
|---|---|---|
| 501927 | 3/1951 | Belgium . |
| 9013727 | 11/1990 | WIPO . |

*Primary Examiner*—David M. Purol
*Attorney, Agent, or Firm*—Ladas & Parry

[57] ABSTRACT

A lifting folding door, having two primarily vertically extending rails, each arranged on one side of an opening to be closed by the door; a number of panels hinged together, each guided by both rails; and a guiding system connected at the top of each of the rails for guiding the panels such that, when moving upward, the panels are folded together in zigzag fashion by their hinge connections in primarily horizontal direction above the rails. An operating system is provided for driving at least one of the panels in vertical direction, and the guiding system gradually deflects the panels in horizontal direction, starting from the beginning of vertical movement. Consequently, a purely vertical movement is gradually converted into a movement of a horizontal component, so that the dynamic forces acting on the respective elements are minimized, and therefore the speed can be significantly increased.

10 Claims, 10 Drawing Sheets

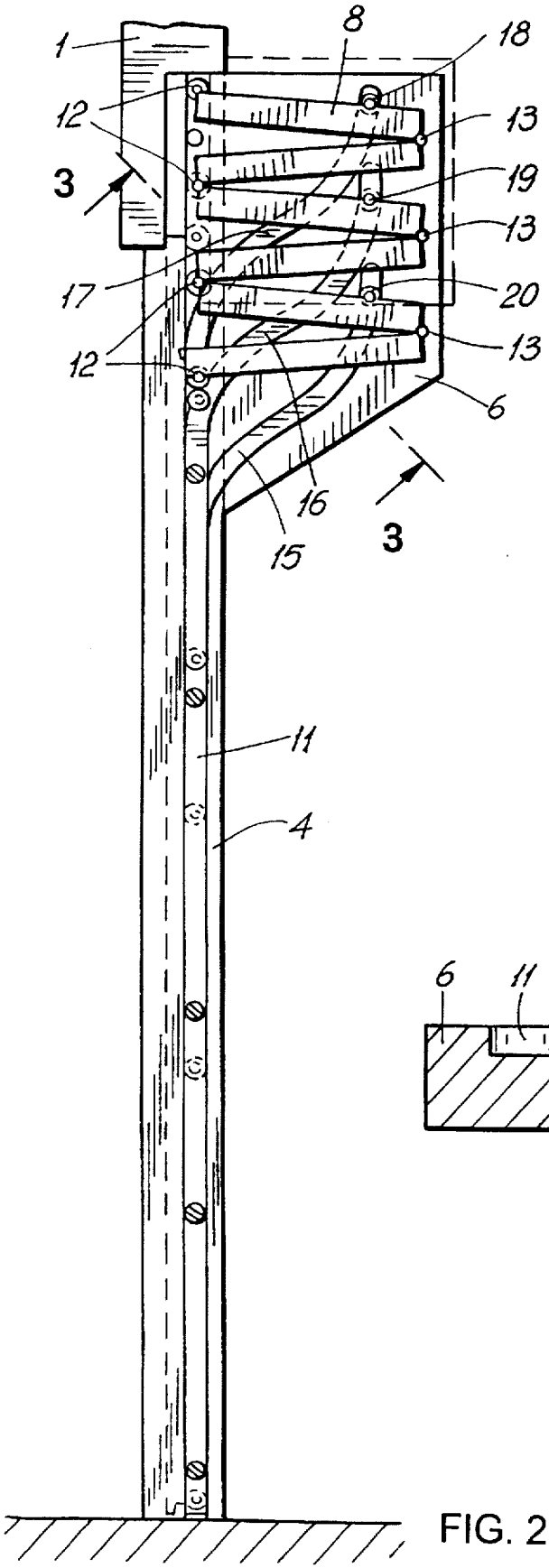
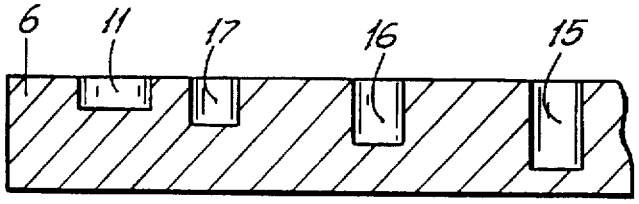
FIG. 3
FIG. 2

LIFTING FOLDING DOOR

This application is a continuation of copending application International Application PCT/NL95/00317 filed on Sep. 22, 1995 and which designated the U.S.

FIELD OF THE INVENTION

The present invention relates to a lifting folding door comprising a number of panels hinged together, two primarily vertically extending rails arranged each on one side of the opening to be closed by the door for guiding the panels, a number of guide rails arranged next to each vertically extending rail, said guide rails extending towards the top of each of the vertically extending rails for guiding the panels such that, when moving upward, they are folded together in zigzag fashion in primarily horizontal direction, said panels comprising first guide elements for guiding the panels in the vertically extending rails and a number of second guide elements for guiding the panels in the guide rails, said number of second guide elements being equal to the number of guide rails, said rails being adapted for unequivocally determining the lateral movement and the rotation of the panels.

BACKGROUND AND PRIOR ART

Such a lifting door is known from U.S. Pat. No. 3,618,656. This known folding door comprises two pairs of panels to which guide rollers, which form the second guide elements, are pivotally connected, which guide rollers guide the panels through respective guide tracks, which are formed by channels. Because of the pivotally connected guide rollers the door can be raised from its extended position to its folded position without placing undue stress on the door operating system.

SUMMARY OF THE INVENTION

The goal of the invention is to provide an alternative lifting folding door which can be opened and closed with high speed.

This goal is obtained according to the present invention by means of a lifting folding door of the type mentioned above, which is characterized in that the second guide elements are rigidly attached to the panels.

Per se, second guide elements which are rigidly connected to panels of a folding door are, for example, known from AU-B-20968/92. AU-B-20968/92, however, relates to a lifting door of the type comprising only one guide rail pair for all second guide elements, i.e. for all panels, and this guide rail is not adapted for unequivocally determining the lateral movement and rotation of the panels. Apart from that, U.S. Pat. No. 3,618,656 teaches away from using rigidly connected second guide elements in the lifting door type which is the subject of U.S. Pat. No. 3,618,656.

In order to prevent that a second guide element follows a wrong guide rail, the lifting folding door according to the invention is preferably provided with selection means for selectively guiding each of the second guide elements into the corresponding guide rail.

BRIEF DESCRIPTION OF THE FIGURES OF THE DRAWING

The present invention shall be explained hereafter by means of the enclosed figures, which show:

FIG. 2: a cross section view of the folding door depicted in FIG. 1, in which the rail mounted on one side and the guiding means arranged above it are shown in side view;

FIG. 3: a cross section along line III—III of FIG. 2;

DETAILED DESCRIPTION

Figure 1:
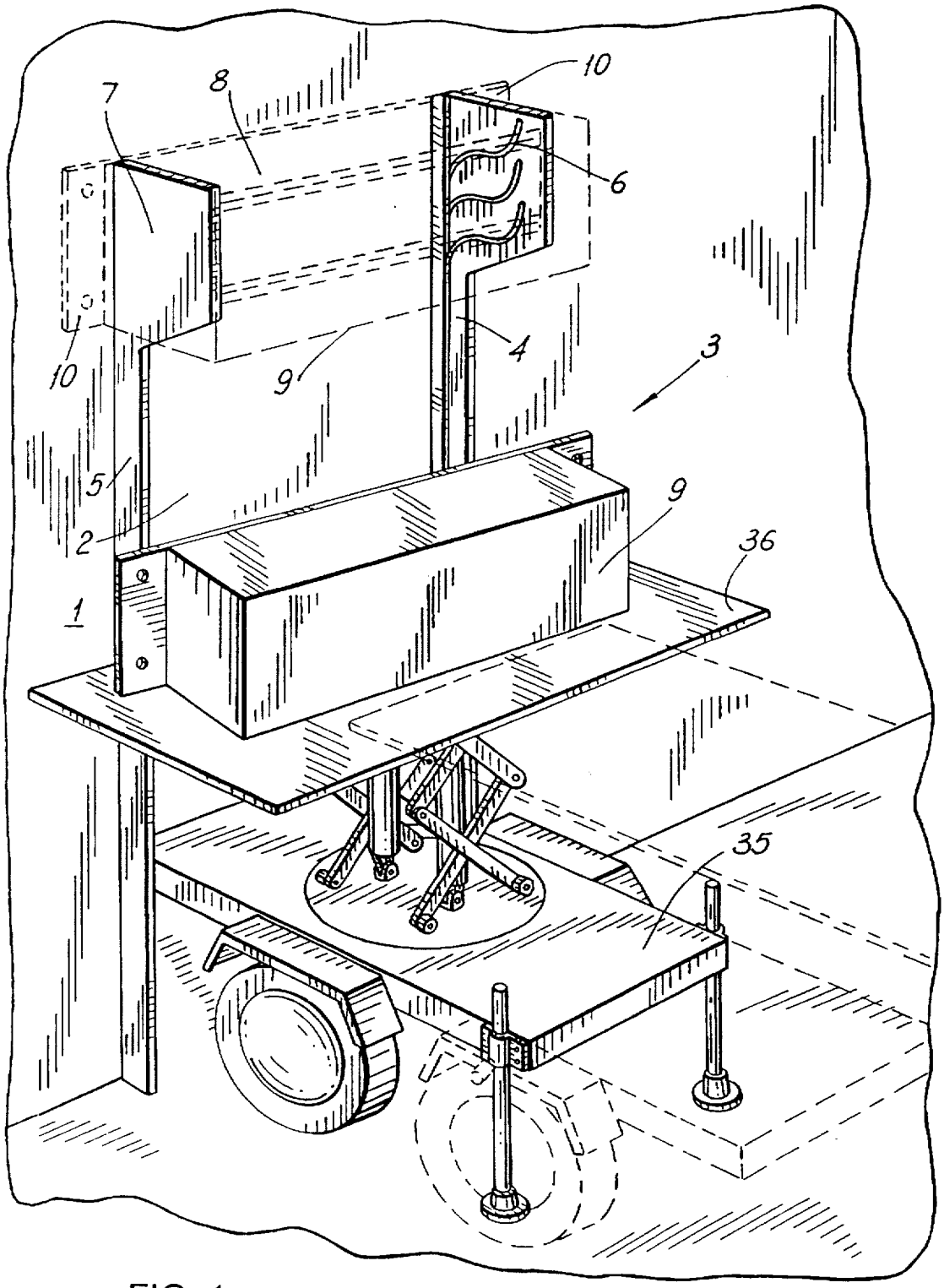
FIG. 1: a schematic perspective view of a lifting folding door according to the present invention, in particular, during its assembly.

FIG. 1 shows a wall 1, in which an opening 2 is made, which must be closed by a lifting folding door according to the present invention. The lifting folding door in its entirety is indicated by 3. The lifting folding door contains two rails 4, 5, each arranged at one side of the opening 2, while guiding means 6, 7 are arranged at the top of each of the rails 4, 5 in the form of plates in which appropriate channels are made. The lifting folding door further contains panels 8, indicated by broken lines in FIG. 1, which in the opened condition of the door are folded together between the guiding means 6, 7, as depicted in FIG. 1.

In order to protect the folded panels, the guiding means 6, 7 are installed in an assembly unit 9, likewise indicated by broken lines. This assembly unit is secured to the wall 1 by means of cheeks 10. Moreover, FIG. 1 shows how such a unit is mounted. This shall be later clarified in the description.

Next, a first embodiment of the invention shall be explained more closely by means of FIG. 2.

FIG. 2 shows the rail 4, as seen form the opening 2, together with the guide element 6 placed above it. Arranged in the rail 4 is a track in the form of a channel 11. Pins that are connected to the panels 8 are guided in channel 11.

In this particular embodiment, the door contains six panels 8, each of which can be folded together in zigzag fashion, being provided with an outer hinge 12 on one side, and each being joined to an inner hinge 13 at the inside. The placement of the inner and outer hinges 12, 13 is such that, when the door is folded, the outer hinges remain on the outside of the door and the inner hinges end up on the inside of the door. The outer hinges 12 are each joined to a pin, which is guided by channel 11. Of course, each of the outer hinges 12 is provided with a corresponding pin at its other side, which is guided by a rail present at the outer side of the door opening, in which a corresponding channel is made.

It is possible, of course, to adapt the invention to doors with a different, even number of panels, such as 4, 8, 10 or 12. It is also possible to adapt the invention to an odd number of panels, such as 5 or 7. In this case, however, provision must be made for guiding the next, larger even number of panels.

Moreover, of each pair of panels 8 joined together by means of an inner hinge 13, the upper panel 8 provided with a guide pin 18, 19, 20 likewise extends into the channel 11. During the upward movement of the panels, the respective pins 18, 19, 20 must bend in order to guarantee a good folding action. Accordingly, the guiding means 6 designed in the form of a plate are provided with deflection tracks in the form of channels 15, 16, 17. Now, of course, the danger exists that during the upward movement the pins connected to the outer hinges 12 will end up in the deflection channels 15, 16, 17, the guide pins 18, 19, 20 will continue to follow the main track in the form of the extension of the channel 11, of they will end up in the wrong deflection channel.

Therefore, the channel 11, i.e., the main track is made broad, as are the pins which are fastened to the outer hinges 12. The deflection channels 15, 16, 17 are made more narrow, thus preventing the broad pins from getting into the deflection channels. This is evident in FIG. 3. Also, the deflection channels 15, 16, 17 are made more narrow than the channel 11. The same applies to the pins 18, 19 and 20. The pins 18, 19, 20 are more narrow than the guide pins that are joined to the outer hinges 12. Moreover, the deflection channels 15, 16, 17 are deeper than the channel 11 at the location of the guide means. The channel 11 in the rails 3, 4 is, naturally, just as deep as channel 17, because the respective pin must also be guided through this channel. The differing depth accomplishes an effect such that the pin 18 is guided in the channel 17 during the upward movement, as are subsequently the pin 19 in the channel 16 and pin 20 in channel 15, thus accomplishing the required effect.

It will be clear that, after the deflection of the track 15, which is the deepest, only the deeper pin is carried along, because the continuation of channel 11 is less deep than channel 15. A similar situation holds for the other deflection tracks. Moreover, it is important to the invention that the deflection of the deflection channels 15, 16, 17 is gradual, so that even at high speeds of movement the dynamic deflection forces are low, and thus the device is suitable for high speeds.

In the sample embodiment represented here, the pins 18, 19, 20 are arranged on the panels 8. It is, of course, just as possible to fasten the pins to the innermost hinges 13. Furthermore, it is possible to execute the device in negative manner. That is, the pins connected to the inner hinges 12 and the guide pins 18, 19, 20 can be replaced by forklike structures, which are guided along guideways. Once again, it is possible to work with differing thickness and/or depths.

In the above embodiment, the pins 18, 19, 20 are always arranged on the uppermost panels of each pair. It is, of course, equally possible to fasten the pins to the lowermost panels, or to fasten them to the inner hinges 13. This also applies to the other embodiments.

Figure 4:
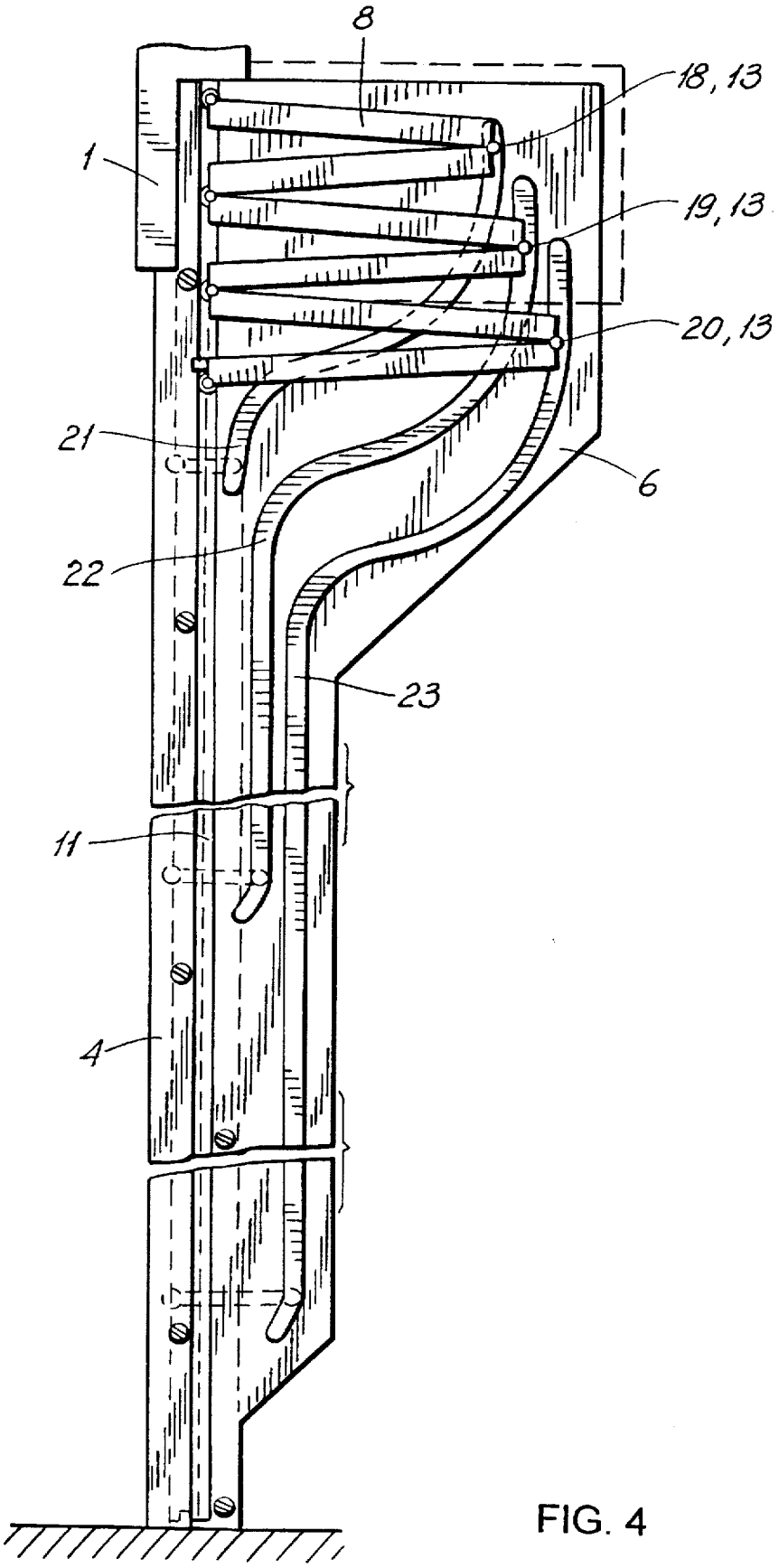
FIG. 4: a view of a second embodiment of a lifting door, similar to FIG. 2.

FIG. 4 shows an embodiment that is especially suitable for higher speeds; each of the pins always has its own guideway here. The inner hinges 13 in this embodiment are each connected to the pins 20, 19, 18, respectively, and each of the pins travels in a separate channel 23, 22, 21, respectively, which are shaped so that the required action is achieved. Once again, it is important that the deflection of the channels 21, 22, 23 is gradually, so that the speed of movement of the door can be as high as possible. In FIG. 4, the panels form pairs of different width; it is, of course, possible to adapt panels with the same width. For the placement of the guides in FIG. 4, the guide pins would have to be fastened to the panels.

Moreover, in the embodiment represented in FIG. 4, the channels 21, 22 and 23 point outwardly at their underside, in order to force the panels 8 in their closed position outwardly against a seal, not shown in the drawing.

Figure 5:
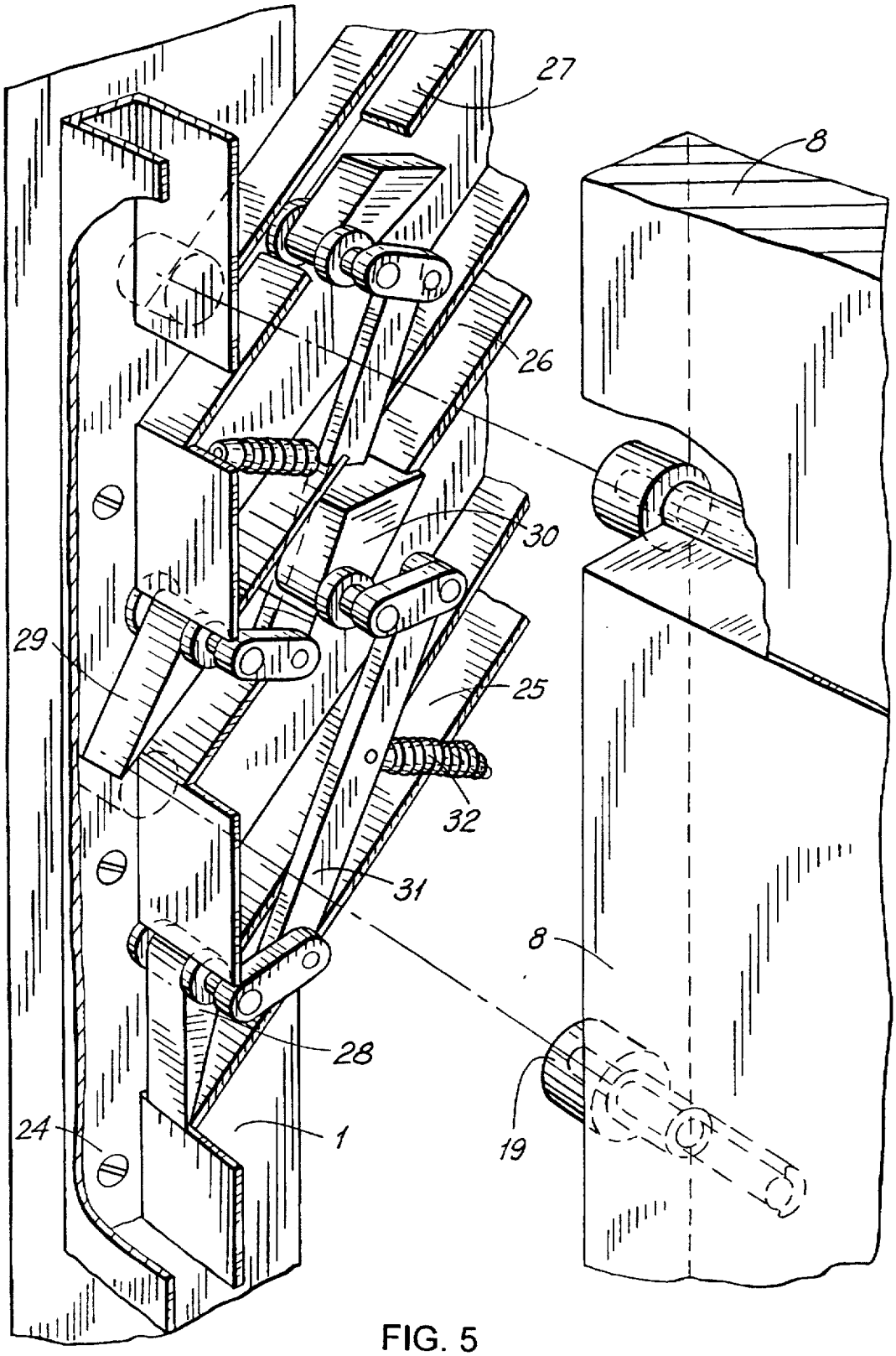
FIG. 5: a perspective detail view of a third embodiment of the lifting folding door according to the invention.

FIG. 5 shows an arrangement in which the selection of the pins occurs by means of "points" or switches in the form of switch elements. Thus, this embodiment contains a track in the form of a channel 24, that is intended exclusively for the guiding of the pins 18, 19, 20, connected to the panels 8, or inner hinges 13. The pins connected to the outer hinges 12 move along a channel not shown in the present figure. Once again, there are deflection tracks in the form of deflection channels 25, 26 and 27, respectively. At the point where the deflection channel 25 branches off from the main channel 24, a switch element 28 is arranged. By maintaining the switch element in the indicated position, the moving pin will follow the main channel, while in the other position with the deflection element 28, as represented for the deflection channel 26, the pin will follow the deflection channel. To operate the layout, use is made of a mechanism comprised of a cam 30, which is placed in the deflection channel located above the particular deflection channel, and which is joined to the deflection unit 28 by means of a lever system 31. In order to hold the deflection element 28 in its normal indicated position, there is a spring 32. This means that, whenever the particular pin travels in a deflection element, the particular cam is operated, thus moving the deflection element from the channel located underneath to the deflection position. Although a rather sudden deflection is indicated in this sample embodiment, it should be clear that any other more fluid one could be produced, consistent with the invention; the sketch only shows a schematic representation to illustrate the principle.

Figures 6, 7:
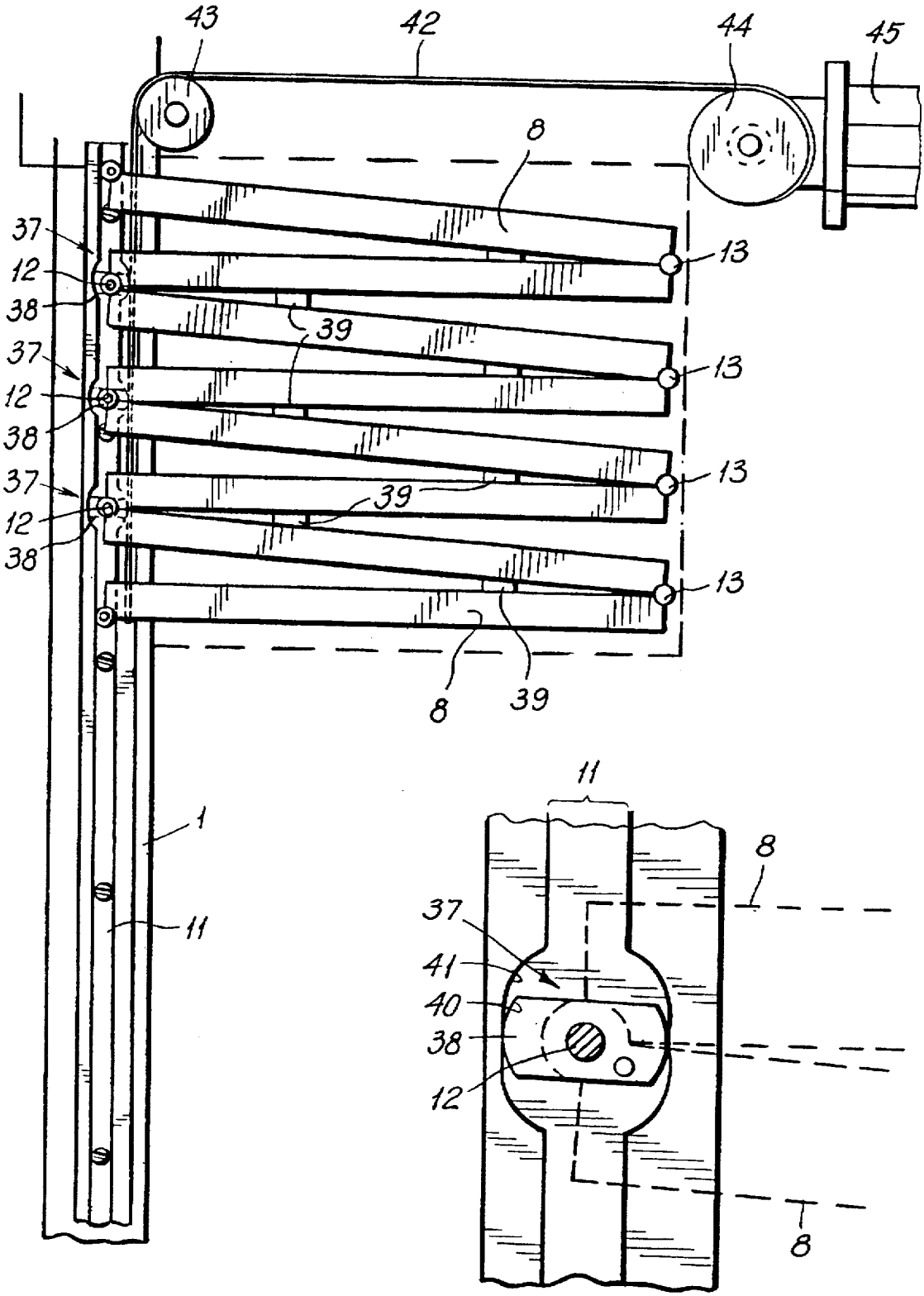
FIG. 6: a cross-section view of a fourth embodiment of the invention.
FIG. 7: a detailed view of the embodiment depicted in FIG. 6.

In the fourth embodiment, shown in FIG. 6, there is a different kind of selection mechanism. The channel 11 here is not provided with branches, and there are no separate guide elements present for the inner hinges, or guide pins connected to the panels 8 in the vicinity of the inner hinges 13. Instead, the upper portion of the channel 11 is provided with enlargements 37, while the upper panel of each pair of panels 8 is joined to a cam 38 at the outer hinges 12. In other words, the cam 38 for turning about the hinge 12 is rigidly connected to the lower panel 8 of the pair of panels that the outer hinge 12 is connected to.

Moreover, between every pair of panels 8 there is placed a draw spring, schematically indicated in the drawings by the reference number 39.

The particular cam structure is shown in greater detail in FIG. 7. As can be seen, the cam 38 is provided with rounding 40 at its head end, while the enlargement 37 is also provided with rounding 41. The roundings 40 and 41 serve to facilitate the turning of the cam 38 in the enlargement 37.

Moreover, a lifting mechanism is present in this embodiment in the form of a cord 42, which is connected at the lower end to the lower end of the lowermost panel 8, being guided through a guide pulley 43 above the position of the uppermost panel 8 and wound on a winding drum 44, which is operated by means of an electric motor 45, for example. It should be clear that such a lifting mechanism must also be present in the previously explained embodiments. In place of this, of course, other lifting mechanisms can be used, e.g., a circular chain or a hand-operated lifting mechanism. This applies to all sample embodiments, of course.

In the embodiment depicted in FIG. 6, moreover, the cord 42 is not connected to the hinges. However, it is possible to guide the cord 42 in zigzag fashion around the hinges 13 and 12, so that the cord exerts the respective folding forces. It is then possible to eliminate the tension springs 39.

During the upward movement of the lower end of the cord 42, the lower end of the lowermost panel 8 will be pulled upward, while the other panels, in the present case 8, will follow along. Because of the fact that the cams 38 are enclosed in the channel 11, and therefore they cannot turn, the three lowest pairs of panels cannot be folded, so that the upper pair of panels 8 is necessarily folded.

This process continues until the upper pair of panels is completely folded, and the uppermost cam 38 has arrived in the uppermost enlargement 37, as represented in FIG. 6. It then becomes possible to fold the next upper pair of panels 8, which is also the only possibility, after which the next upper cam 38 ends up in an enlargement and the following pair of panels is folded. This process continues, depending on the number of panels used, of course, until all panels are folded, and the situation shown in FIG. 6 is attained.

In order to encourage the folding action, tension springs 39 are arranged between each pair of panels. Of course, it is possible to leave out one pair of each set of springs 39.

It is possible, of course, to combine the principle of the broadened cams, adopted in FIGS. 6 and 7, with the other embodiments. As a result of these measures, the outside of the panels is prevented from sagging and becoming skewed in the guides.

It is even possible to employ such a zigzag guidance of the cord in one of the preceding embodiments.

Figure 8:
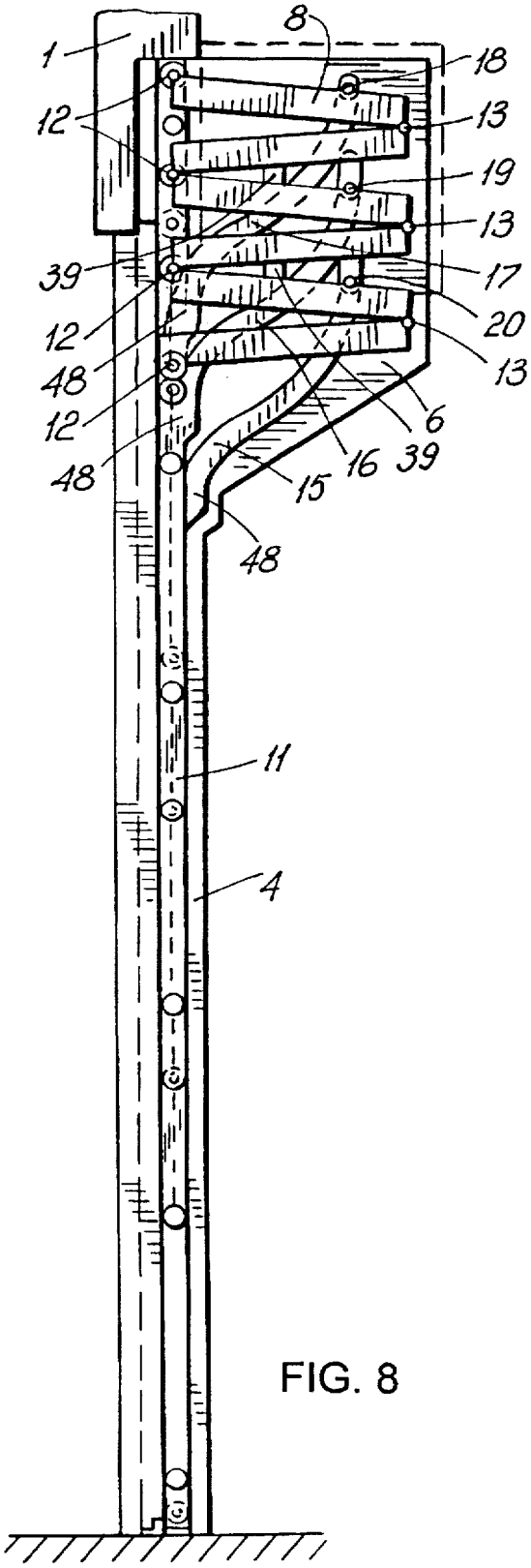
FIG. 8: a cross section of a fifth embodiment of the invention.

The embodiment shown in FIG. 8 largely coincides with the embodiment shown in FIG. 2. The embodiment shown in FIG. 8 differs in that the channel 11 is provided with enlargements, indicated by 48, at the place where the deflection channels diverge from the channel 11. These enlargements have the purpose of making the deflection of the pins and, thus, the panels more gradual than that in the former embodiment, discussed by means of FIG. 2. In this embodiment, a draw spring 39 is arranged between each pair of panels, in order to ensure that the pins and, thus, the panels follow the deflection track and fold together. In order to guide the pins into the proper tracks under these forces directed toward the diverging channels, the depth of the respective channels is reversed; thus, the channel 15 is the least deep in the embodiment of FIG. 8, channel 16 is somewhat deeper than channel 15, and channel 17 is the deepest. Of course, the main channel 11 is the most deep, in order to prevent the pins connected to the outer hinges 12 from moving into the diverging channels. It is also possible, as in the embodiment of FIG. 2, to make these pins thicker.

However, it is also possible to guide the pins connected to the outer hinges in a separate rail. One then obtains a configuration agreeing with that of FIG. 4, with the understanding that the channels 21, 22 and 23 are consolidated.

Figure 9:
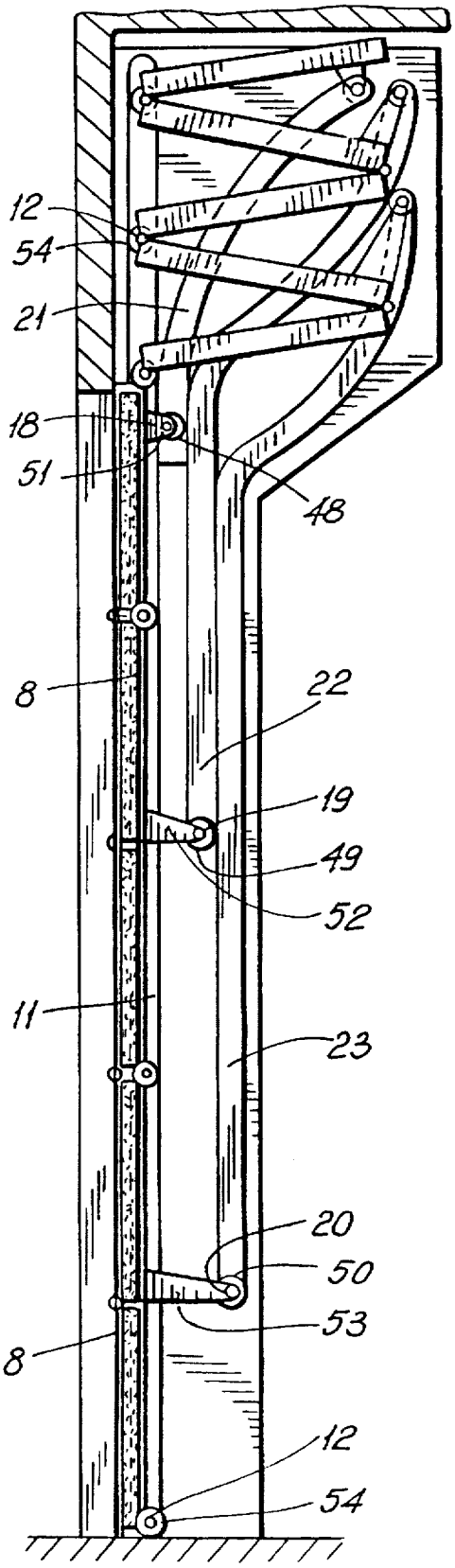
FIG. 9: a cross section of one variant of an embodiment represented in FIG. 4.

The embodiment depicted in FIG. 9 agrees in most respects with the embodiment shown in FIG. 4, but differs in that the guide pins 18, 19, 20 are provided with guide wheels 48, 49, 50, respectively. Furthermore, the guide pins are joined to the panels 8 by means of arms 51, 52, 53, respectively. The guide wheels ensure a better guidance in the separate tracks 21, 22, 23, respectively, so that the movement occurs with less friction. The guide pins 12 arranged on the outside are also provided with guide wheels 54. The embodiment further differs in that an odd number of panels 8 is employed, and the top side of the uppermost panel is folded inward.

Besides, it is also possible to locate the guiding wheels with the other panels on a similar way as with the single upper panel. The tracks all have then a shape which is coherent with the shape of track 21.

Figure 10:
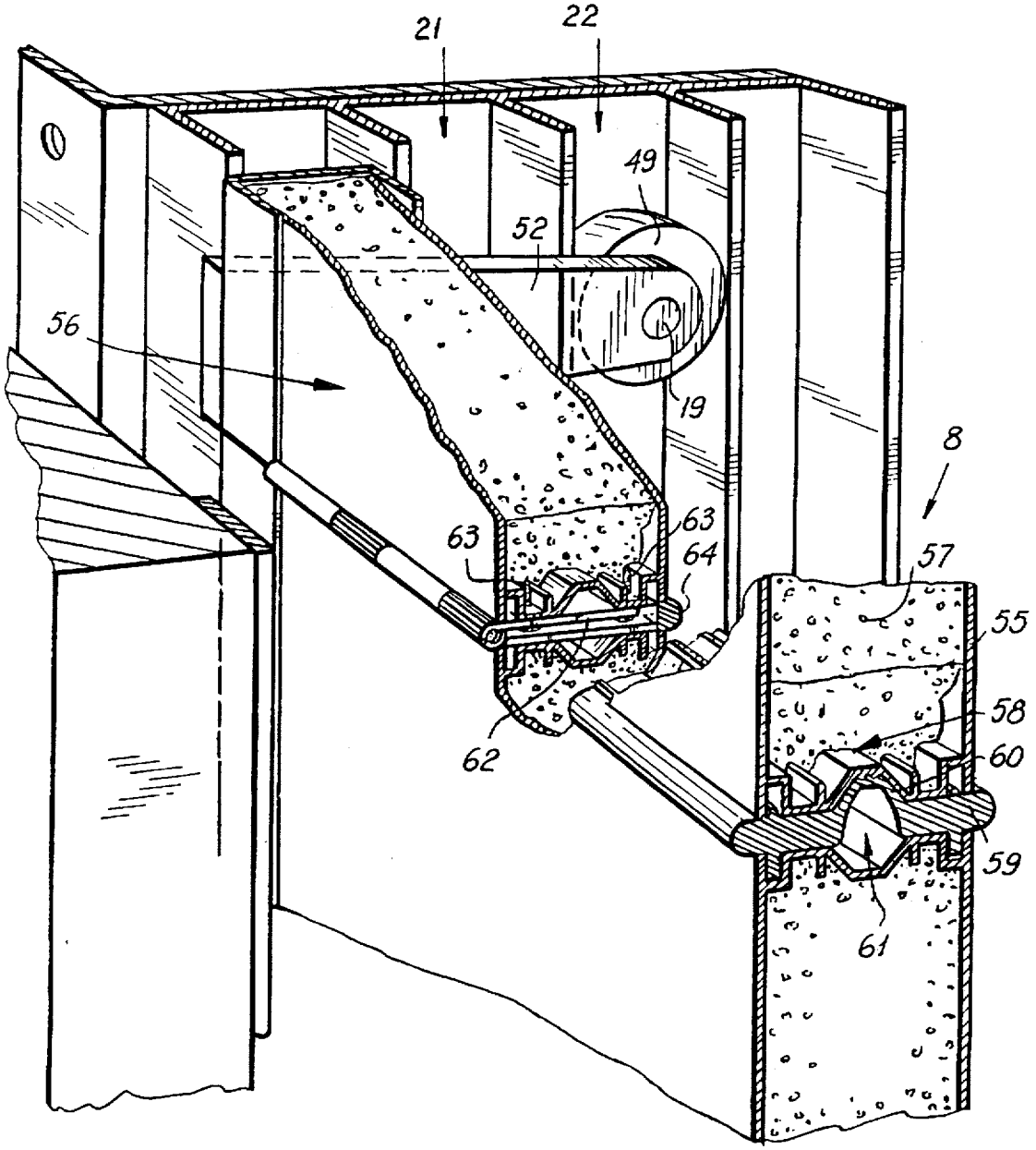
FIG. 10: a detailed view partially broken away of the variant shown in FIG. 9.

FIG. 10 shows the structure of the panels in more detail. Each of the panels 8 is formed by a sandwich structure with an inner wall 55 and an outer wall 56, between which is filler material 57 in the form of a plastic foam. At the lower side, the panel is closed by a profile 58 and, as shown in the drawing, constructed as a unit with the inner wall by means of, e.g., pop rivets, a screw connection, or by means of welding or gluing. Each panel is closed at its upper end by means of a similar profile 58. Thus, according to one embodiment, it is possible to form the panels in their entirety by means of extrusion. However, this is in no way necessary for the application of the invention. After the extrusion, of course, the panels must be filled with foam. For a good closure between the panels when the door is closed, use is made of a rubber profile 59 that is provided with a protuberance 60 which is exactly fitted to each of the profiles 58. For this purpose, the profiles 58 are provided with an indentation 61. Thus, it is also possible to employ the profile 59 in the other way. Again, the profile 59 can be joined to one of the profiles 58 by means of vulcanization or gluing, for example. Thus, a good seal is achieved in the closed condition.

For joining together the panels, use is made of hinges 62, the leaves of which are joined by means of screws 63 to the profiles 58. The profile 59 is partly cut away at the hinges. This ensures that no additional space is needed for the hinges, while a good seal is achieved by keeping part of one edge 64 of the closing profile.

Figure 11:
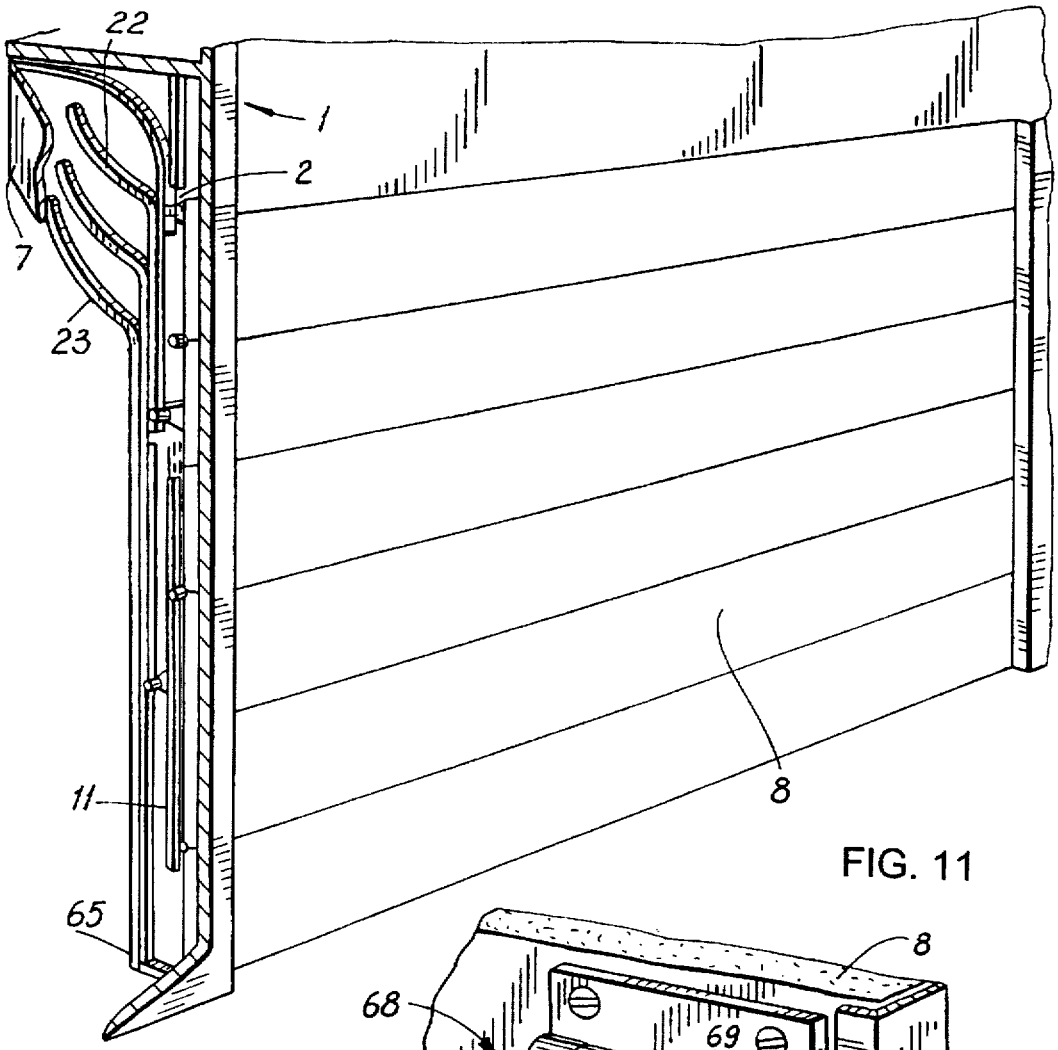
FIG. 11: a view of the partially broken away variant shown in FIGS. 9 and 10.
Figure 12:
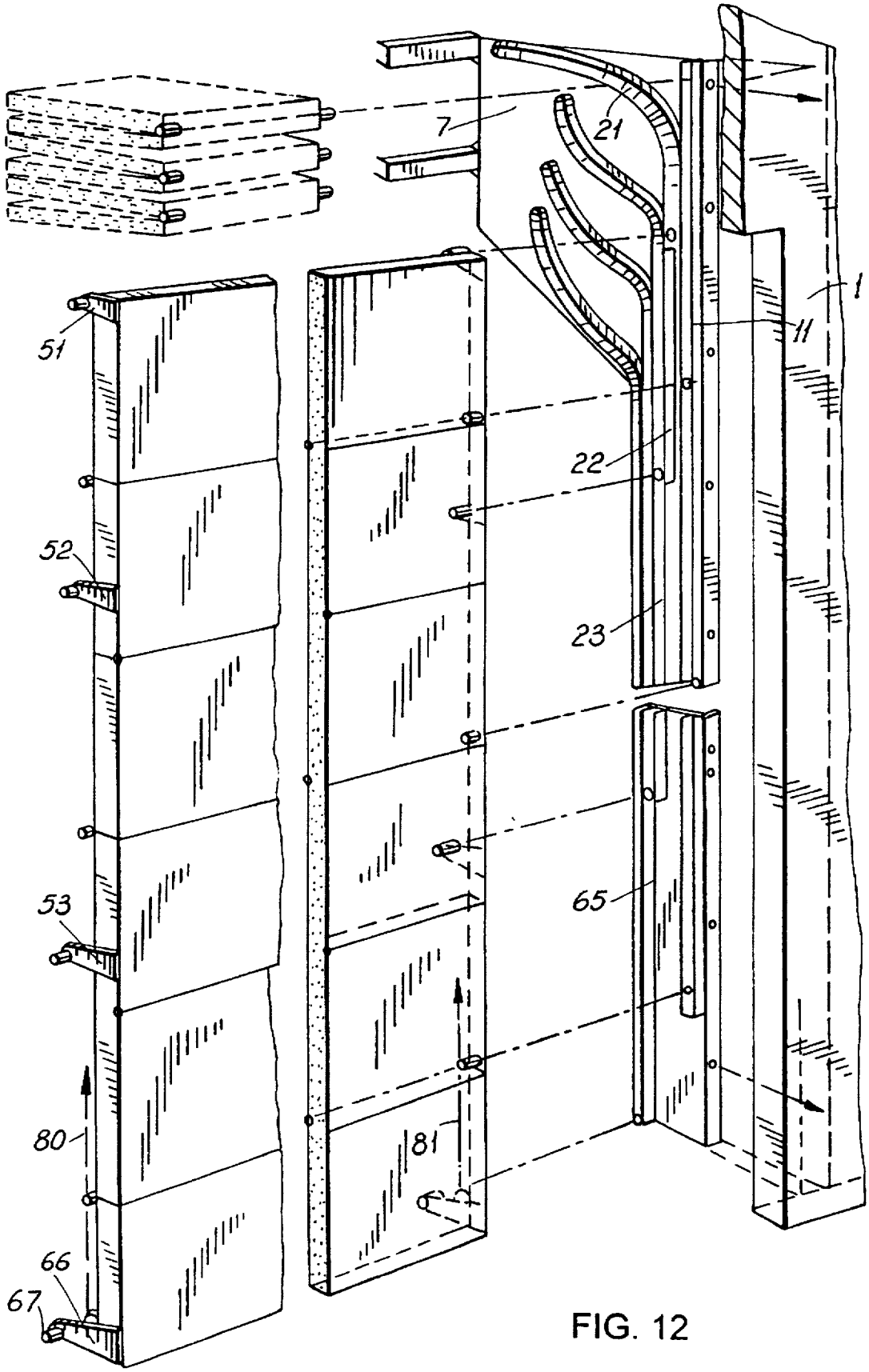
FIG. 12: a detailed view of the embodiment shown in FIG. 9.

The arrangement according to the above embodiment is shown from the exterior in FIG. 11. It follows from this that an even number of panels is employed in this embodiment, but it is constructed such that the upper end of the uppermost panel folds inward, as does the lower end of the lowermost panel. For this, an extra guide rail 65 is mounted, extending entirely downward. All of this is shown in detail in FIG. 12. It is noted that the depicted embodiment is fit for an odd number of panels. Therefore, the upper panel comprises an extra guide pin 51 which is guided in guide element 21. This offers further the possibility to give the upper panel a more limited heigth. Moreover, an extra arm 66 with an extra guide pin 67 on it is installed, of course.

According to an embodiment not represented on the drawing, the guide wheels 48, 49, 50 are replaced by balls. This has the advantage that they can turn in any direction, so that the friction against both the sides and the bottom of the rail is as little as possible. Of course, it is difficult to mount a ball. It is also possible in theory to employ a V-shaped rail, in which the ball makes constant contact at two points. This simplifies the bearing problem of the ball.

Figure 13:
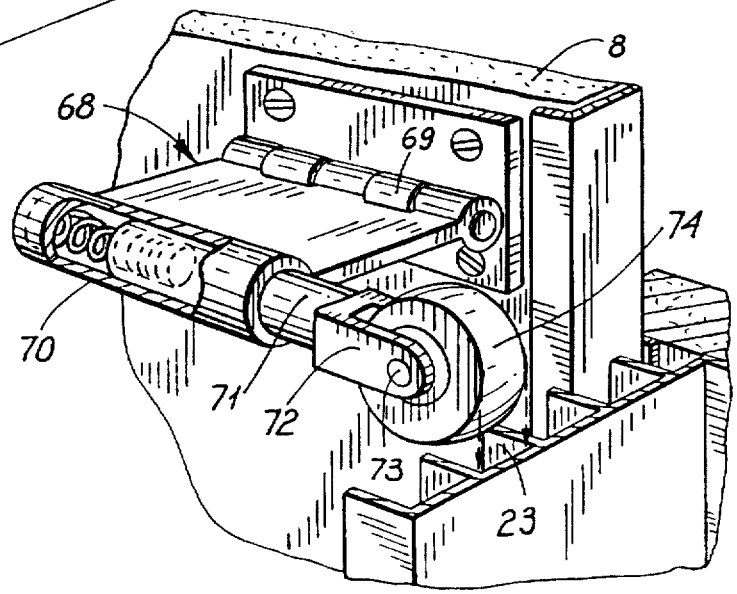
FIG. 13: a detailed view of steps to prevent skewing.

FIG. 13 shows a detailed view of a device for preventing skewing of the panels of the lifting folding door. This arrangement is formed by an arm 68, which is connected by means of a hinge 69 to one of the panels 8. Fastened to the arm is a bushing 70, in which a pin 71 is springloaded in the axial direction. The pin 71 is connected to a fork 72, through the outer ends of which an axle 73 is arranged, on which a wheel 74 is mounted. The wheel 74 turns against the head wall of one of the channels 21, 22, or 23, or in the main channel 11 itself. It is possible to provide each of the panels 8 with such an arrangement at each of their corners. However, it is also possible and, given the interconnection of the panels, presumably only necessary to place two of such arrangements on each of the panels. It is also possible to connect the arm 68 rigidly to the panel 8, or to combine it with one of the arms 51, 52 or 53.

It should be noted that the balls in the previous paragraph fulfill the very same function.

Figure 14:
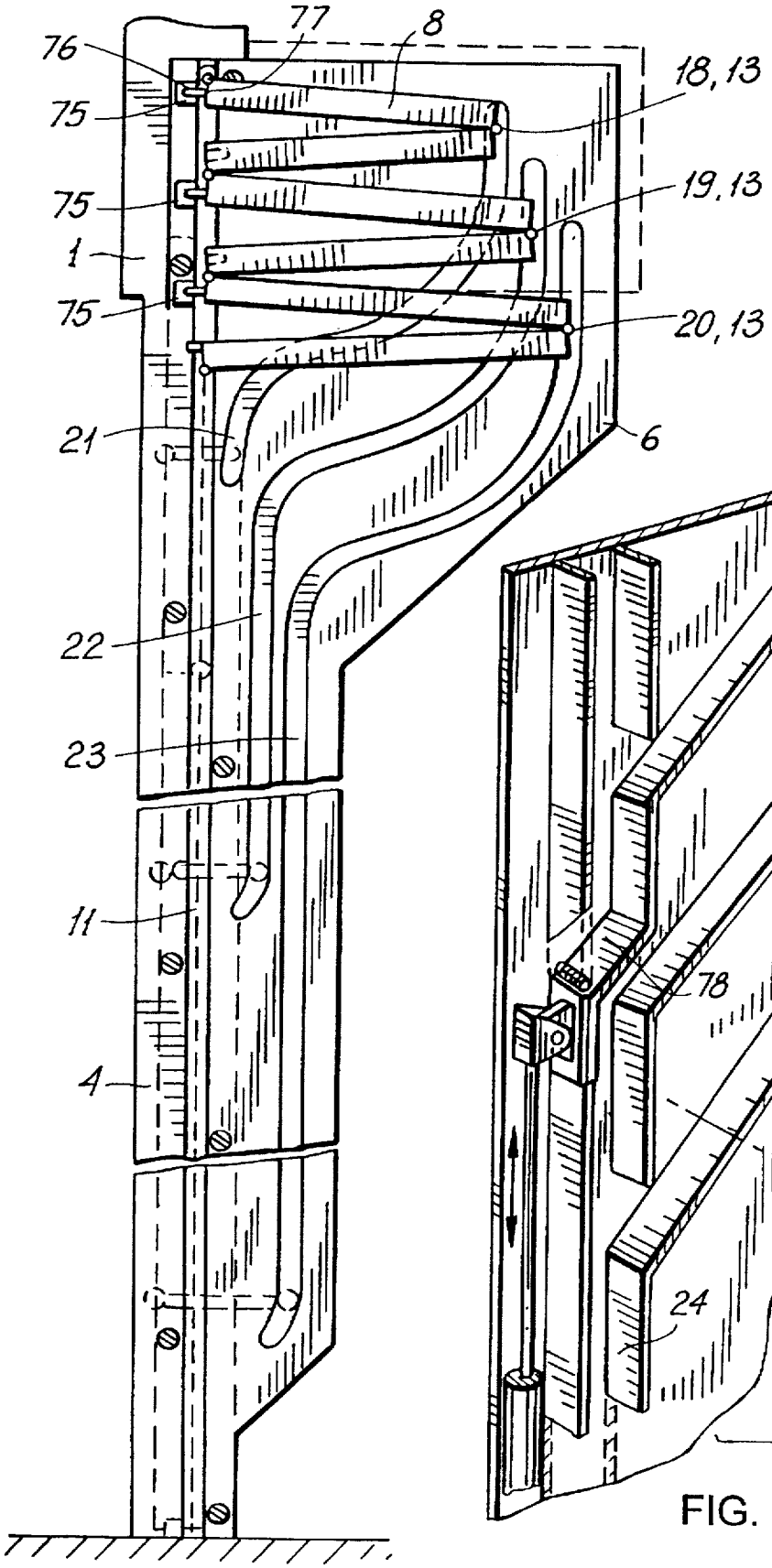
FIG. 14: a variant of the embodiment shown in FIG. 4.

Moreover, FIG. 14 shows a different variant, in which, in order to prevent the outside of the elements from moving downward during the folding of the elements, supports are arranged in the form of U-shaped elements 75. In these elements 75, a cavity 76 is made, being outwardly rounded at its lower end. To engage with the cavities, at the top end of each odd element (counting from the top) a pin 77 is arranged, which engages with the cavity and basically prevents the front of the panels from moving downward. Moreover, they fulfill a certain guiding function. Of course, suitable recesses are made at the pins 77 in the panels located above them.

In this embodiment, the action is improved by creating a certain clamping action of the pins 77 in the cavity 76. This is accomplished, for example, by lining the cavity 76 with material having a large coefficient of friction, for example, rubber. Moreover, it is important that the pins 77 and the elements 75 of each of the panels are placed at different distances from the edges of the door opening, in order to prevent the pins of different distances from the edges of the door opening, in order to prevent the pins of different panels being hindered by the elements 75 of pins belonging to other panels.

In the situation that the number of panels is even, and the upper panel is shorter than the remaining panels, the free end of the upper panel cannot be fixed by the cams. Therefore, a specific guide track can be provided in the guide means, in which guide pins attached to the relevant panel are guided.

Figure 15:
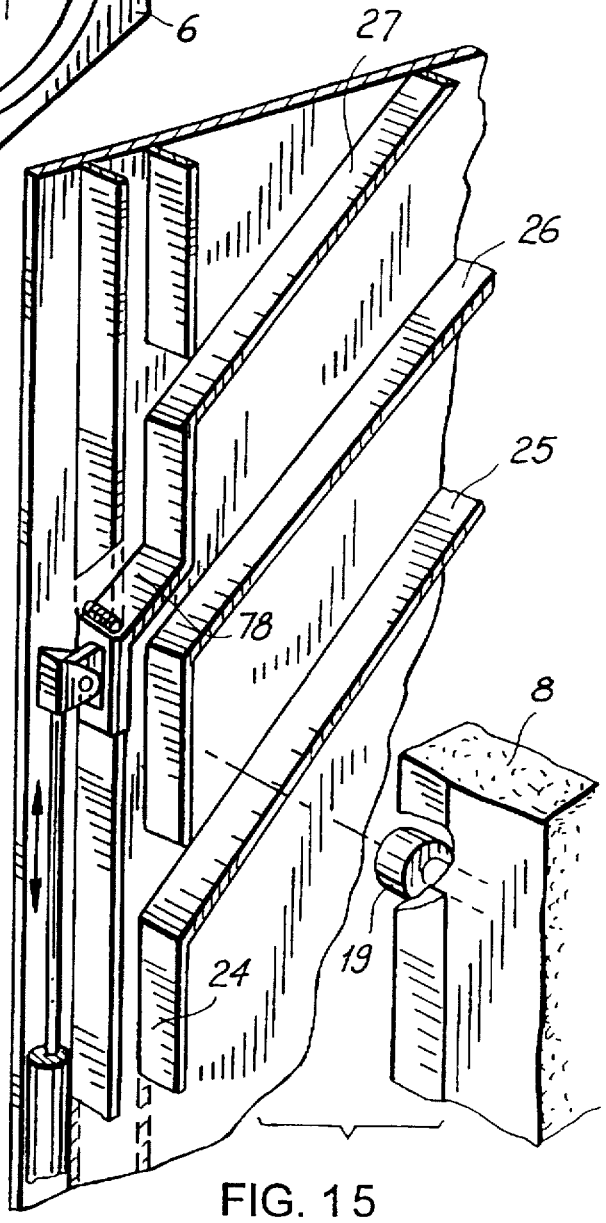
FIG. 15: a variant of the embodiment shown in FIG. 5.

In the variant shown in FIG. 15, a shoe 78 is arranged in the upper part 24 of the channel, acting as a closing element or movable switch. The shoe 78 is adjustable in height and provides connections to different deflection tracks at different positions.

It should be clear that many other different selection mechanisms are possible; thus, for example, it is possible to electronically control the deflection elements 28, 29 of the embodiment depicted in FIG. 5. This has the advantage that the same guide rail 24 can be used for guiding of the pins arranged on the outer hinges. However, it is still important that the deflection tracks diverge gradually, in order to achieve the best possible action. It should be mentioned here that the selection mechanism also has a positioning function.

It is also possible to separate the selection function of the selection means from their guide function. Thus, for example, it is possible to employ steering wheels, which control the guide means in the form of pins so that they select the proper deflection track.

In the embodiment described above, we have hardly mentioned the actuation; actuation is possible by means of cables that are fastened, e.g., to the lowermost panel. In this case, a cable is fastened to the panel on either side of the closed opening. However, it is also possible to employ, for example, four cables, which are fastened in pairs to the lowermost panel on each side of the opening being closed; one cable of each pair is then fastened to the outside of the panel and the other cable to the inside of the panel. The cables are then connected to the panels situated above. This fastening is such that the cables extending on the inside are fastened to the hinges which must fold inwardly, and the cables extending on the outside are connected to the hinges which must fold outwardly. Thus, these cables also form a selection mechanism. The cables can each be wound on a single drum or on a pair of drums located at one side of the door. One of the cables should then be guided over the aperture of the door. This obviates the need for a through going shaft.

Finally, again making use of FIG. 1, we shall discuss the assembly of the lifting folding door according to the present invention. For this, an assembly unit 9 is brought up, for example, on a truck 35, which is provided with a platform 36 that can rise and turn. The aforesaid assembly unit 9 is placed on this platform 36, whereupon the truck 35 is driven into the opening which is to be closed, the platform 36 is moved upward and turned until the assembly unit 9 located on it has reached the correct position, and this is secured in place by means of the cheeks 10 and a suitable fastening material. Next, the rails 4, 5 which are brought up separately, are put in place and fastened, after which, after affixing the various operating elements, the connection of the power supply, and so forth, the unit can be placed in operation. After this, the truck 35 can be taken away.

Instead of a liftable platform, it is possible for instance to make use of a fork-lift truck. Of course, it is possible to use other lifting or hoisting mechanisms, for instance a hoisting crane. Then means will have to be provided to couple the mounting unit to the hoisting crane, for instance by means of a levelling rod.

It should be clear that this allows an especially convenient and attractive fastening, since the heavy elements are punt in place by means of the rising platform.

What is claimed is:

1. Folding door (3) comprising a number of panels (8) hinged together, two substantially vertically extending rails (11, 12) arranged each on one side of an opening (2) to be closed by the door (3) for guiding the panels (8), two sets of a number of guide rails (15, 16, 17; 21, 22, 23) each set being arranged next to a respective one of said vertically extending rails (11, 12), said guide rails (15, 16, 17; 21, 22, 23) extending towards a top of each of the vertically extending rails (11, 12) for guiding the panels (8) such that, when moving upward, the panels are moved in a substantially horizontal position and are stacked on one another, said panels (8) comprising first guide elements for guiding the panels in the vertically extending rails (11, 12) and a number of second guide elements (18, 19, 20, 48, 49, 50) for guiding the panels (8) in the guide rails, said number of second guide elements being equal to the number of guide rails, said vertically extending rails and said guide rails (11, 12, 15, 16, 17, 21, 22, 23) being in the form of channels for guiding the respective guide elements therein and being constructed and arranged for gradually deflecting the panels (8) in a horizontal direction, starting from the vertical movement of the panels, and operating means (42, 43, 44, 45) for driving at least one of the panels (8) in vertical direction, wherein each second guide element (18, 19, 20; 48, 49, 50) is rigidly attached to a respective panel (8) such that each of the second guide elements (18, 19, 20; 48, 49, 50) is fixed in position relative to its respective panel (8).

2. Folding door (3) as claimed in claim 1, wherein the guide rails (15, 16, 17; 21, 22, 23) branch off from the respective vertically extending rail (11, 12).

3. Folding door (3) as claimed in claim 1, further comprising selection means (28, 29, 30, 31, 32) for selectively guiding each of the second guide elements (18, 19, 20) into corresponding guide rails (15, 16, 17).

4. Folding door (3) as claimed in claim 3, wherein the selection means includes switches (28) that selectively connect a lower part of each of the guide rails (15, 16, 17; 21, 22, 23) to an upper part thereof.

5. Folding door (3) as claimed in claim 4, further comprising an electronic controller for operating said switches (28).

6. Folding door (3) as claimed in claim 4, further comprising mechanical control elements for controlling said switches (28).

7. Folding door (3) as claimed in claim 4, wherein said switches (28) comprise height-adjustable deflection elements (78).

8. Folding door (3) as claimed in claim 3, wherein each of the vertically extending rails (11, 12) and the guide rails (15, 16, 17) respectively comprise tacks, each having a specific depth.

9. Folding door (3) as claimed in claim 2, wherein the panels have different widths.

10. Folding door (3) according to claim 1, wherein the number of panels is an odd number.

* * * * *